US009199786B2

(12) United States Patent
Femino

(10) Patent No.: US 9,199,786 B2
(45) Date of Patent: Dec. 1, 2015

(54) PACKAGING FOR TRANSPORTATION OF CUTTING DEVICES

(71) Applicant: Maureen Cynthia Femino, Harvard, MA (US)

(72) Inventor: Maureen Cynthia Femino, Harvard, MA (US)

( * ) Notice: Subject to any disclaimer, the term of this patent is extended or adjusted under 35 U.S.C. 154(b) by 0 days.

(21) Appl. No.: 13/899,617

(22) Filed: May 22, 2013

(65) Prior Publication Data

US 2013/0313144 A1 Nov. 28, 2013

Related U.S. Application Data

(60) Provisional application No. 61/651,770, filed on May 25, 2012.

(51) Int. Cl.

| | |
|---|---|
| ***B65D 59/04*** | (2006.01) |
| ***B65D 85/00*** | (2006.01) |
| ***B65D 5/66*** | (2006.01) |
| *B26B 29/02* | (2006.01) |

(52) U.S. Cl.

CPC ..... *B65D 85/00* (2013.01); *B65D 5/6658* (2013.01); *B65D 59/04* (2013.01); *B26B 29/025* (2013.01)

(58) Field of Classification Search

CPC .... A45C 13/02; B26B 29/025; B65D 5/6658; B65D 59/04; B65D 85/00

USPC ..... 206/349, 372, 553, 459.5; 229/149–150; 30/1

See application file for complete search history.

(56) References Cited

U.S. PATENT DOCUMENTS

| | | | | | |
|---|---|---|---|---|---|
| 1,499,994 | A * | 7/1924 | Marx | 206/738 |
| 1,508,382 | A * | 9/1924 | Chatillon | 206/349 |
| 1,521,656 | A * | 1/1925 | Simpson | 30/1 |
| 1,693,591 | A * | 12/1928 | Chatillon | 206/553 |
| 2,044,701 | A * | 6/1936 | Junkin | 229/150 |
| 2,638,212 | A * | 5/1953 | Robertson | 206/372 |
| 2,646,916 | A * | 7/1953 | Meller | 229/149 |
| 2,811,296 | A * | 10/1957 | Long | 229/150 |
| 3,870,148 | A * | 3/1975 | Hite | 206/372 |
| 4,714,159 | A * | 12/1987 | Linden | 206/349 |
| 5,291,996 | A * | 3/1994 | Linden | 206/349 |
| 5,375,700 | A * | 12/1994 | Joss et al. | 206/553 |
| 5,699,907 | A * | 12/1997 | Langenstuck | 206/349 |
| 6,209,783 | B1 * | 4/2001 | Collins | 229/149 |
| 7,520,386 | B1 * | 4/2009 | Griffin | 206/372 |
| 7,798,324 | B2 * | 9/2010 | Wojcik | 206/372 |

* cited by examiner

*Primary Examiner* — Bryon Gehman

(74) *Attorney, Agent, or Firm* — Anderson Gorecki & Rouille LLP

(57) ABSTRACT

A device for the packaging and transportation of objects to be sharpened is presented. The packaging includes a box defining a space therein and at least one blade cover adapted to fit over a blade of a device to be sharpened and disposed inside the space defined by the box. The box includes a bottom; a first side in mechanical communication with the bottom; a second side in mechanical communication with the bottom and the first side; a third side in mechanical communication with the second side and the bottom; a fourth side in mechanical communication with the third side, the first side and the bottom; and a cover in mechanical communication with the third side and capable of being secured over the space and held in place by a locking mechanism. The box and blade cover are approved for use in the U.S. mail service.

8 Claims, 3 Drawing Sheets

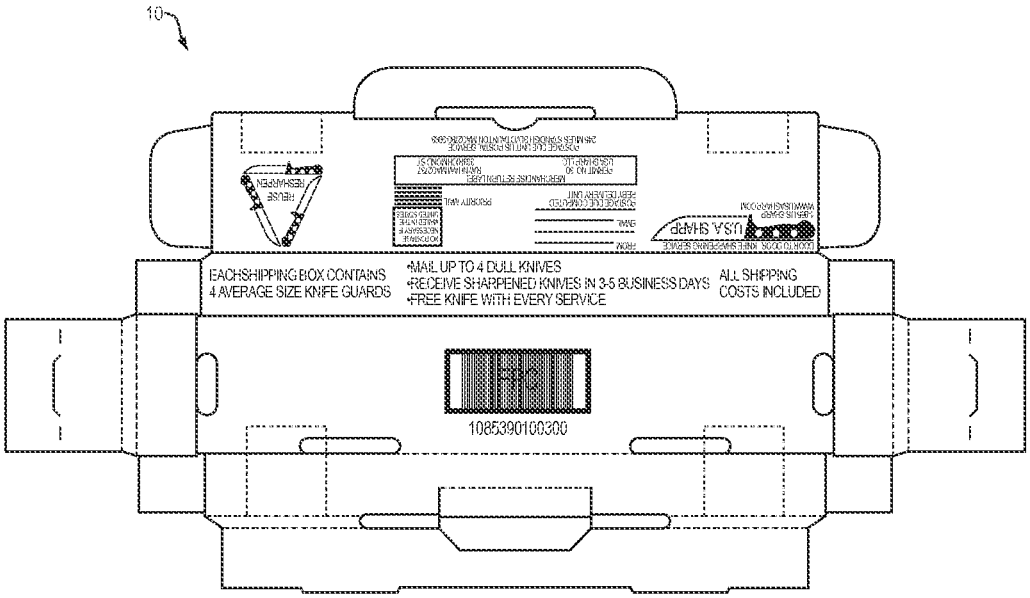
FIG. 1
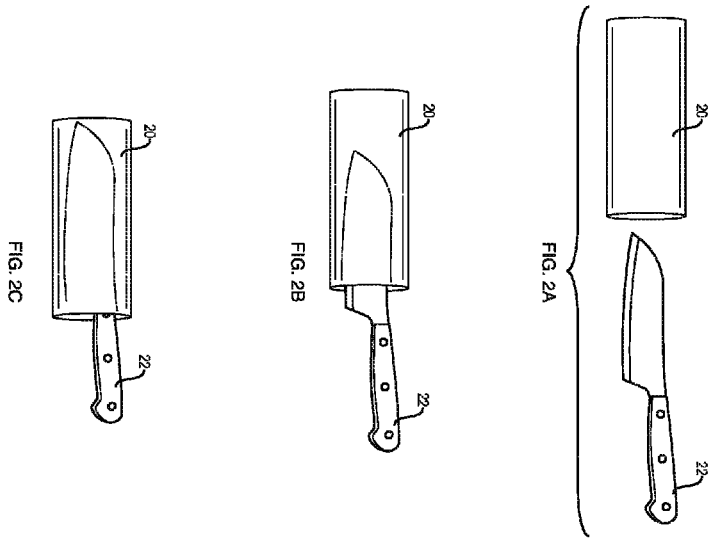
FIG. 2C
FIG. 2B
FIG. 2A

PACKAGING FOR TRANSPORTATION OF CUTTING DEVICES

CROSS REFERENCE TO RELATED APPLICATIONS

The present application claims the benefit of U.S. Provisional Patent Application No. 61/651,770 filed on May 25, 2012, which is incorporated herein by reference in its entirety.

BACKGROUND

Cutting devices come in many sizes and shapes and may include a blade of some type. Cutting devices may include knives, scissors, tool blades, and the like. Knife sharpening has long been used by food handlers for many years for the purpose of maintaining their dull knives that allows for sharp and efficient slicing, dicing, filleting, chopping etc. Knife sharpening has gone back to the turn of the century by a craftsmen/knife sharpener pushing a cart with an attached grinding wheel for easy transportation and convenience. The knife sharpeners would sharpen knives on the spot. As automobiles became more abundant the delivery method began to grow quicker and more efficient with more coverage across the region(s).

SUMMARY

Conventional knife or tool sharpening methods, such as those explained above, suffer from a variety of deficiencies. For example, it is difficult for a homeowner to have cutting devices sharpened. The example in the drawings and described below are done so with respect to knives, however it should be understood that the present invention is not limited to knives and can be used for a variety of cutting devices. For a knife owner to transport the knives to a sharpening place requires the owner having to package the knives, transport them to the sharpening business, and then later return to retrieve the knives. Transporting the knives can be dangerous, especially if a person attempted to use the mail service as a means of delivering the knives to the sharpener.

It is accordingly an object of the invention to eliminate or alleviate at least some of the problems referred to above. The presently packaging for the transportation of objects to be sharpened includes a box defining a space therein and at least one blade cover adapted to fit over a blade of a device to be sharpened and disposed inside the space defined by the box. The box includes a bottom; a first side in mechanical communication with said bottom; a second side in mechanical communication with said bottom and said first side; a third side in mechanical communication with said second side and said bottom; a fourth side in mechanical communication with said third side, said first side and said bottom; and a cover in mechanical communication with said third side and capable of being secured over said space and held in place by a locking mechanism. The box and blades cover are approved for use in the U.S. mail service.

Note that each of the different features, techniques, configurations, etc. discussed in this disclosure can be executed independently or in combination. Accordingly, the present invention can be embodied and viewed in many different ways.

Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views.

The drawings are not necessarily to scale, emphasis instead being placed upon illustrating the principles of the invention.

FIG. 1 is a drawing of a box used in the packaging and transportation of objects to be sharpened, in accordance with embodiments of the invention;

FIGS. 2A-2C comprise drawings of individual blade covers also used in the packaging and transportation of objects to be sharpened, in accordance with embodiments of the invention;

DETAILED DESCRIPTION

Figure 3:
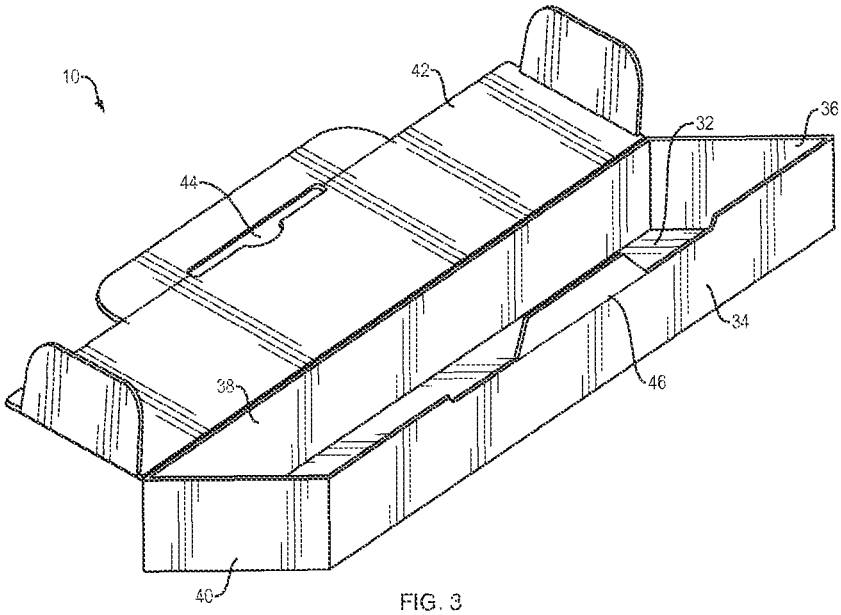
FIG. 3 is a drawing showing a first embodiment of the assembled box used in the packaging and transportation of objects to be sharpened, in accordance with embodiments of the invention.

The embodiments set forth below represent the necessary information to enable those skilled in the art to practice the invention and illustrate the best mode of practicing embodiments of the invention. Upon reading the following description in light of the accompanying figures, those skilled in the art will understand the concepts of the invention and recognize applications of these concepts not particularly addressed herein. It should be understood that these concepts and applications fall within the scope of the disclosure and the accompanying claims.

The preferred embodiment of the invention will now be described with reference to the accompanying drawings. The invention may, however, be embodied in many different forms and should not be construed as limited to the embodiment set forth herein; rather, this embodiment is provided so that this disclosure will be thorough and complete, and will fully convey the scope of the invention to those skilled in the art. The terminology used in the detailed description of the particular embodiment illustrated in the accompanying drawings is not intended to be limiting of the invention. In the drawings, like numbers refer to like elements.

The knife sharpening packaging allows food handlers to easily send their personal knives to be sharpened. The packaging allows knives to be easily sharpened, maintained, repaired and re-sharpened safely and securely in a re-usable kit, which is made of recyclable corrugated box/cardboard and or plastic material(s). The locking mechanism on the kit folds neatly and snugly inside the kit. The kit includes a plurality of knife guards that safely cover the knife blades for extra blade safety in the transportation of the kit. The kit also includes shipping labels that adhere to the outside of the box. A removable shipping label is attached to the top of the box for delivery. Below the removable sticker is a bar coded return address printed on the kit to ship "priority" to the knife-sharpening factory. There, the knives are sharpened and immediately returned to the customer. The bar coding allows for free shipping in both directions.

The packaging may be used as part of a rental service geared toward commercial customers including, but not limited to, restaurant kitchens, delicatessens, butchers, and the like, wherein the knife sharpening and delivery is provided on a weekly, bi-weekly, or monthly basis or customized.

Referring now to FIG. 1, box 10 is shown in an unassembled state. Box 10 is preferably provided as a single piece of material pre-cut and printed which is easily assembled to form a box. The box (and blade cover) are approved for use in the U.S. mail service.

FIGS. 2A-2C shows a blade cover and a knife 22. In FIG. 2A, the blade cover 20 and knife 22 are shown before insertion. As can be seen in FIG. 2B, the blade of knife 22 is insertable within blade cover 20, to provide additional protection from the blade. FIG. 2C shows the knife 22 fully inserted within blade cover 20.

Referring now to FIG. 3, an assembled box 10 is shown. Box 10 includes a bottom 32 and a first side 34 in mechanical communication with the bottom 32. Box 10 further includes a second side 36 in mechanical communication with said bottom 32 and said first side 34. Also included as part of box 10 is a third side 38 in mechanical communication with said second side 36 and said bottom 32. Box 10 additionally includes a fourth side 40 in mechanical communication with said third side 38, said first side 34 and said bottom 32. Box 10 also features a cover 42 in mechanical communication with said third side 38 and capable of being secured over said space and held in place by a locking mechanism. The locking mechanism includes a first part 44 (slot) included as part of cover 42 and a second part 46 (tab) included as part of first side 46. The locking mechanism secures cover 42 in a closed position by having the tab 46 inserted in slot 44.

Figure 4:
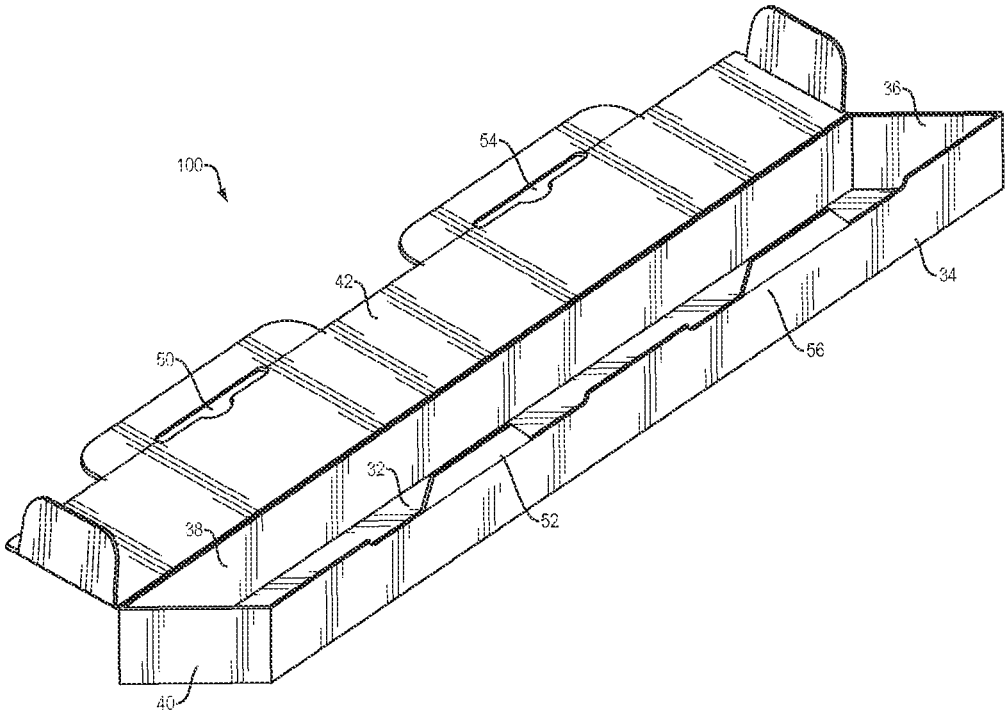
FIG. 4 is a drawing showing a second embodiment of the assembled box used in the packaging and transportation of objects to be sharpened, in accordance with embodiments of the invention.

Referring now to FIG. 4, a second embodiment of an assembled box 100 is shown. Box 100 includes a bottom 32 and a first side 34 in mechanical communication with the bottom 32. Box 10 further includes a second side 36 in mechanical communication with said bottom 32 and said first side 34. Also included as part of box 10 is a third side 38 in mechanical communication with said second side 36 and said bottom 32. Box 10 additionally includes a fourth side 40 in mechanical communication with said third side 38, said first side 34 and said bottom 32. Box 10 also features a cover 42 in mechanical communication with said third side 38 and capable of being secured over said space and held in place by a plurality of locking mechanisms. The locking mechanisms include respective first parts 50 and 54 (slots) included as part of cover 42 and respective second parts 52 and 56 (tabs) included as part of first side 46. The locking mechanisms secure cover 42 in a closed position by having the tab 52 inserted in slot 50 and having tab 56 inserted in slot 54.

Figure 5:
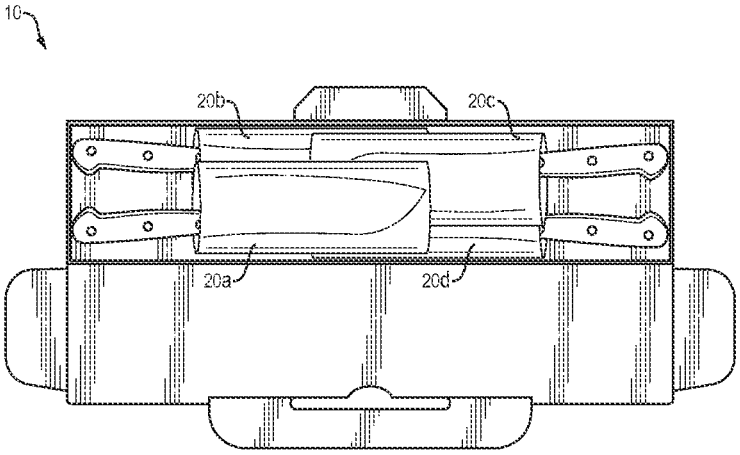
FIG. 5 is a diagram showing the packaging including objects to be sharpened in accordance with embodiments of the invention.

FIG. 5 shows the presently described packaging for transportation of cutting devices with several cutting devices installed. Box 10 has been assembled and four cutting devices (knives in this example) have had their blades inserted in respective sleeves 20*a*, 20*b*, 20*c*, and 20*d*. The knives with their respective sleeves are arranged in an alternating configuration within the box 10 as shown. The cover would then be closed, the locking mechanisms engaged, the shipping labels (not shown) applied, and the knives are ready for transportation to the sharpener. In a particular embodiment, four covers for four cutting tools are used. This is due to the fact that most home knife sets have eight knives, so half would be sent out for sharpening while the other half are still used at home. Upon return of the four knives (now sharpened), the same packaging can be used to send the other four knives for sharpening.

Figure 6:
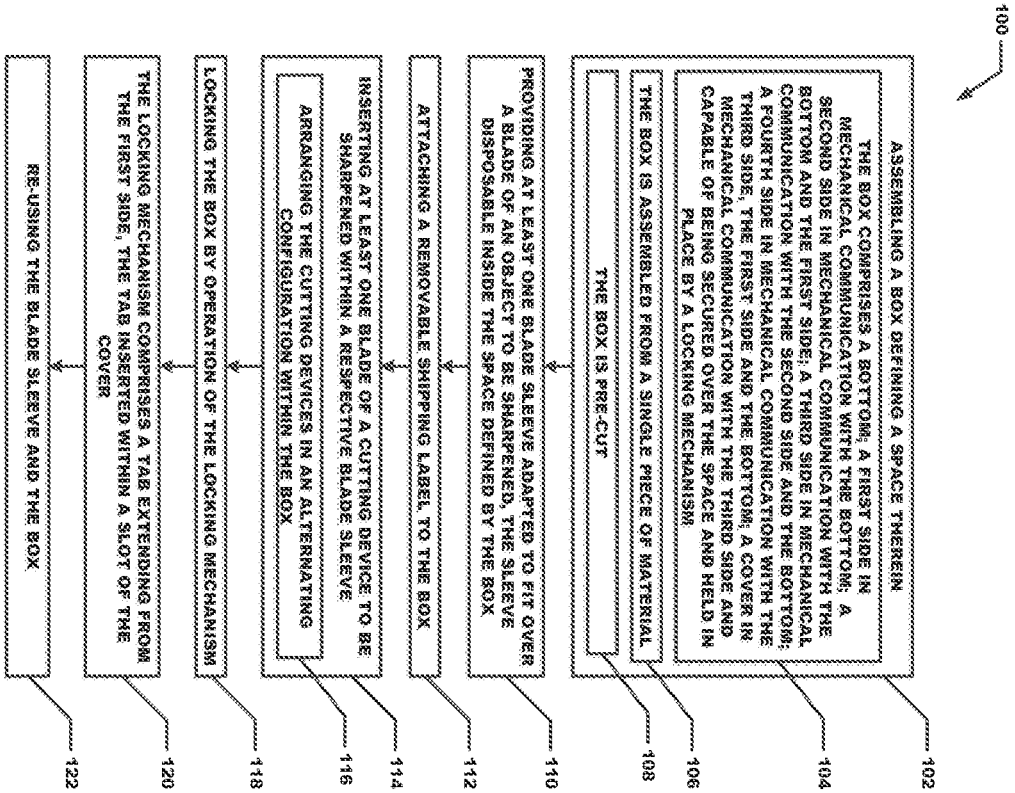
FIG. 6 is a flow diagram of a particular embodiment of using the packaging for transportation of cutting devices in accordance with the present invention.

A flow chart of the presently disclosed method is depicted in FIG. 6. The rectangular elements are herein denoted "processing blocks" and represent computer software instructions or groups of instructions. Unless otherwise stated the steps described below are unordered meaning that, when possible, the steps can be performed in any convenient or desirable order.

Referring now to FIG. 6, a flow diagram of a particular embodiment of a method 100 for assembling and utilizing packaging for transportation of cutting devices. Method 100 begins with processing block 102 which discloses assembling a box defining a space therein. As shown in processing block 104, the box comprises a bottom; a first side in mechanical communication with the bottom; a second side in mechanical communication with the bottom and the first side; a third side in mechanical communication with the second side and the bottom; a fourth side in mechanical communication with the third side, the first side and the bottom; a cover in mechanical communication with the third side and capable of being secured over the space and held in place by a locking mechanism. As shown in processing block 106 the box is assembled from a single piece of material. As shown in processing block 108 the box is pre-cut.

Processing block 110 states providing at least one blade sleeve adapted to fit over a blade of an object to be sharpened, the sleeve disposable inside the space defined by the box. Processing block 112 recites attaching a shipping label to the box.

Processing block 114 discloses the method further includes inserting at least one blade of a cutting device to be sharpened within a respective blade sleeve. Processing block 116 states arranging the cutting devices in an alternating configuration within the box.

Processing block 118 recites locking the box by operation of the locking mechanism. As shown in processing block 120, the locking mechanism comprises a tab extending from the first side, the tab inserted within a slot of the cover. Processing block 122 states re-using the blade sleeve and the box.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

I claim:

1. A device for the packaging and transportation of cutting devices, the device consisting of:

a box defining a space therein, said box consisting of:

a bottom;

a first side in mechanical communication with said bottom;

a second side in mechanical communication with said bottom and said first side;

a third side in mechanical communication with said second side and said bottom;

a fourth side in mechanical communication with said third side, said first side and said bottom; and a cover in mechanical communication with said third side and capable of being secured over said space and held in place by a locking mechanism, wherein said locking mechanism comprises a tab extending from said first side, said tab insertable within a slot of said cover;

a shipping label removably attachable to said box; and a bar-coded return address printed on said box;

at least one additional locking mechanism;

at least one blade sleeve, each sleeve adapted to fit over a blade of a respective cutting device, each said at least one blade sleeve disposed inside said space defined by said box, wherein each said at least one blade sleeve having an opening for receiving a substantial part of a blade, each said at least one blade sleeve completely covering part of the blade.

2. The device of claim 1 wherein said box is provided as a single piece of material.

3. The device of claiml wherein said box is pre-cut.

4. The device of claim 1 wherein said at least one blade sleeve comprises four blade sleeves which are provided with said box.

5. The device of claim 1 wherein said box is re-usable.

6. A method of packaging a cutting device, the method consisting of:

assembling a box defining a space therein, said box consisting of:

a bottom;

a first side in mechanical communication with said bottom;

a second side in mechanical communication with said bottom and said first side;

a third side in mechanical communication with said second side and said bottom;

a fourth side in mechanical communication with said third side, said first side and said bottom;

a locking mechanism, wherein said locking mechanism comprises a tab extending from said first side, said tab insertable within a slot of said cover;

at least one additional locking mechanism;

a cover in mechanical communication with said third side and capable of being secured over said space and held in place by said locking mechanism;

a shipping label removably attachable to said box; and a bar-coded return address printed on said box; and providing at least one blade sleeve, each sleeve adapted to fit over a blade of a cutting device, each said at least one blade sleeve disposed inside said space defined by said box, wherein each said at least one blade sleeve having an opening for receiving a substantial part of a blade, each said at least one blade sleeve completely covering part of the blade.

7. The method of claim 6 wherein said box is assembled from a single piece of material.

8. The method of claim 6 wherein said box is pre-cut.

* * * * *